United States Patent [19]

Fowler

[11] Patent Number: 4,849,595

[45] **Date of Patent: * Jul. 18, 1989**

[54] ELECTRICALLY OPERATED CONTROL DEVICE AND SYSTEM FOR A MICROWAVE OVEN

[75] Inventor: Daniel L. Fowler, Kentwood, Mich.

[73] Assignee: Robertshaw Controls Company, Richmond, Va.

[ * ] Notice: The portion of the term of this patent subsequent to Sep. 29, 2004 has been disclaimed.

[21] Appl. No.: 185,158

[22] Filed: Apr. 22, 1988

Related U.S. Application Data

[62] Division of Ser. No. 71,752, Jul. 9, 1987, Pat. No. 4,755,646, which is a division of Ser. No. 745,669, Jun. 17, 1985, Pat. No. 4,697,057.

[51] Int. Cl.[4] ..... H05B 6/68; G09G 3/02

[52] U.S. Cl. ..... 219/10.55 B; 219/492; 219/506; 99/325; 340/706; 200/37 A

[58] Field of Search ..... 219/10.55 B, 10.55 R, 219/492, 493, 506; 340/706, 753, 365 C, 365 S, 365 R, 364, 802; 200/37 R, 37 A, 11 T W, 11 D A; 99/325, 328

[56] References Cited

U.S. PATENT DOCUMENTS

| | | | |
|---|---|---|---|
| 4,343,977 | 8/1982 | Koyama | 219/10.55 B |
| 4,430,540 | 2/1984 | Scalf | 219/10.55 B |
| 4,568,927 | 2/1986 | Fowler | 200/37 A X |
| 4,625,084 | 11/1986 | Fowler et al. | 200/11 DA |
| 4,697,057 | 9/1987 | Fowler | 219/10.55 B |

*Primary Examiner*—Philip H. Leung

*Attorney, Agent, or Firm*—Candor, Candor & Tassone

[57] ABSTRACT

An electrically operated control device and system for a microwave oven and method of making the same are provided, the device comprising a microprocessor for operating the power unit of the oven at various selected levels thereof, and a selector unit electrically interconnected to the microprocessor for selecting the desired power level that the microprocessor is to operate the power unit, the selector unit comprising a rotary switch that is electrically interconnected to the microprocessor in such a manner that the selector unit has a set sequence of the selection levels as the selector unit is rotated in one direction from a beginning position thereof to an ending position thereof, the beginning position being the position where the selector unit has last set for a previously desired power level setting of the microprocessor.

9 Claims, 10 Drawing Sheets

ELECTRICALLY OPERATED CONTROL DEVICE AND SYSTEM FOR A MICROWAVE OVEN

CROSS REFERENCE TO RELATED APPLICATION

This application is a divisional patent application of its copending parent patent application, Ser. No. 071,752, filed July 9, 1987, now U.S.Pat. No. 4,755,646, which, in turn, is a divisional patent application of its copending parent patent application, Ser. No. 745,669, filed June 17, 1985, now U.S. Pat. No. 4,697,057.

BACKGROUND OF THE INVENTION

1. Field of the Invention

This invention relates to a new electrically operated control device and system for a microwave oven as well as to a method of making such device and system.

2. Prior Art Statement

It is known to provide an electrically operated control device and system for a microwave oven that has power means for cooking food or the like, the device comprising a microprocessor for operating the power means at various selected levels thereof, and a selector means electrically interconnected to the microprocessor for selecting a desired power level that the microprocessor is to operate the power means. Such prior known selector means comprises a slide switch whose beginning position is always the same position of the slide means of the switch relative to the frame means carrying the same.

It is also known to provide an electrically operated control device and system for a microwave oven that has power means for cooking food or the like, the device comprising a microprocessor for operating the power means at various selected levels thereof, a first selector means electrically interconnected to the microprocessor for selecting a desired power level that the microprocessor is to operate the power means and a second selector means electrically interconnected to the microprocessor for selecting a desired time period that the microprocessor is to operate the power means at the desired power level thereof. For example, the aforementioned slide switch arrangement provided such structure.

It is also known to provide an electrically operated control device for a microwave oven wherein a first selector means comprise a rotary switch means for selecting a desired time period that the microprocessor is to operate the power means of the oeven and a second rotary selector means for selecting a desired power level that the microprocessor is to operate the power means, the second rotary selector means comprising a potentiometer. For example, see the copending patent application of Daniel L. Fowler, Ser. No. 433,684, filed Oct. 12, 1982, now U.S. Pat. No. 4,568,927 and published on Apr. 23, 1984, as European patent application publication No. 0,109,182.

SUMMARY OF THE INVENTION

It is a feature of this invention to provide a new electrically operated control device for a microwave oven wherein the rotary selector means for selecting a desired power level of the power means has a beginning position thereof that is not sensitive to the position of the shaft of the selector means.

In particular, it was found according to the teachings of this invention that a rotary selector means can be provided for selecting a desired power level of the power means of a microwave oven, the selector means comprising a rotary switch means that provides a set sequence of the selection levels as the selector means is rotated in one direction from a beginning position thereof to an ending position thereof with the beginning position being the position where the selector means was last set for a previously desired power level setting whereby the operator need not return the rotary selector means to a "home" position after the operation of the oven in order to provide for the same beginning position in the selection sequence for a subsequent operation of the microwave oven as is required by the aforementioned prior known arrangements.

Accordingly, one embodiment of this invention provides an electrically operated control device for a microwave oven that has power means for cooking food or the like, the device comprising a microprocessor for operating the power means at various selected levels thereof, and a selector means electrically interconnected to the microprocessor for selecting a desired power level that themicroprocessor is to operate the power means, the selector means comprising a rotary switch means that is electrically interconnected to the microprocessor in such a manner that the selector means has a set sequence of the selection levels as the selector means is rotated in one direction from a beginning position thereof to an ending position thereof, the beginning position being the position where the selector means was last set for a previously desired power level setting of the microprocessor.

It is another feature of this invention to provide an electrically operated control device for a microwave oven wherein the selector means for selecting a desired time period that the power means for the microwave oven is to operate and the selector means for selecting a desired power level that the power means is to be operated during that selected time period can each comprise a rotary switch means that is substantially identical to the other rotary switch means.

For example, another embodiment of this invention provides an electrically operated control device for a microwave oven that has power means for cooking food or the like, the device comprising a microprocessor for operating the power means at various selected levels thereof, a first selector means electrically interconnected to the microprocessor for selecting a desired power level that the microprocessor is to operate the power means, and a second selector means electrically interconnected to the microprocessor for selecting a desired time period that the microprocessor is to operate the power means at the desired power level thereof, the first and second selector means each comprising a rotary switch means that is substantially identical to the other rotary switch means.

Accordingly, it is an object of this invention to provide a new electrically operated control device for a microwave oven, the device of this invention having one or more of the novel features of this invention as set forth above or hereinafter shown or described.

Another object of this invention is to provide a method of making such an electrically operated control device, the method of this invention having one or more of the novel features of this invention as set forth above or hereinafter shown or described.

Another object of this invention is to provide a new electrically oepated control system for a microwave oven, the system of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIGS. 16A–16D are to be placed together in order to form the complete electrical circuit for the control device of FIG. 1.

DESCRIPTION OF THE PREFERRED EMBODIMENT

Figure 1:
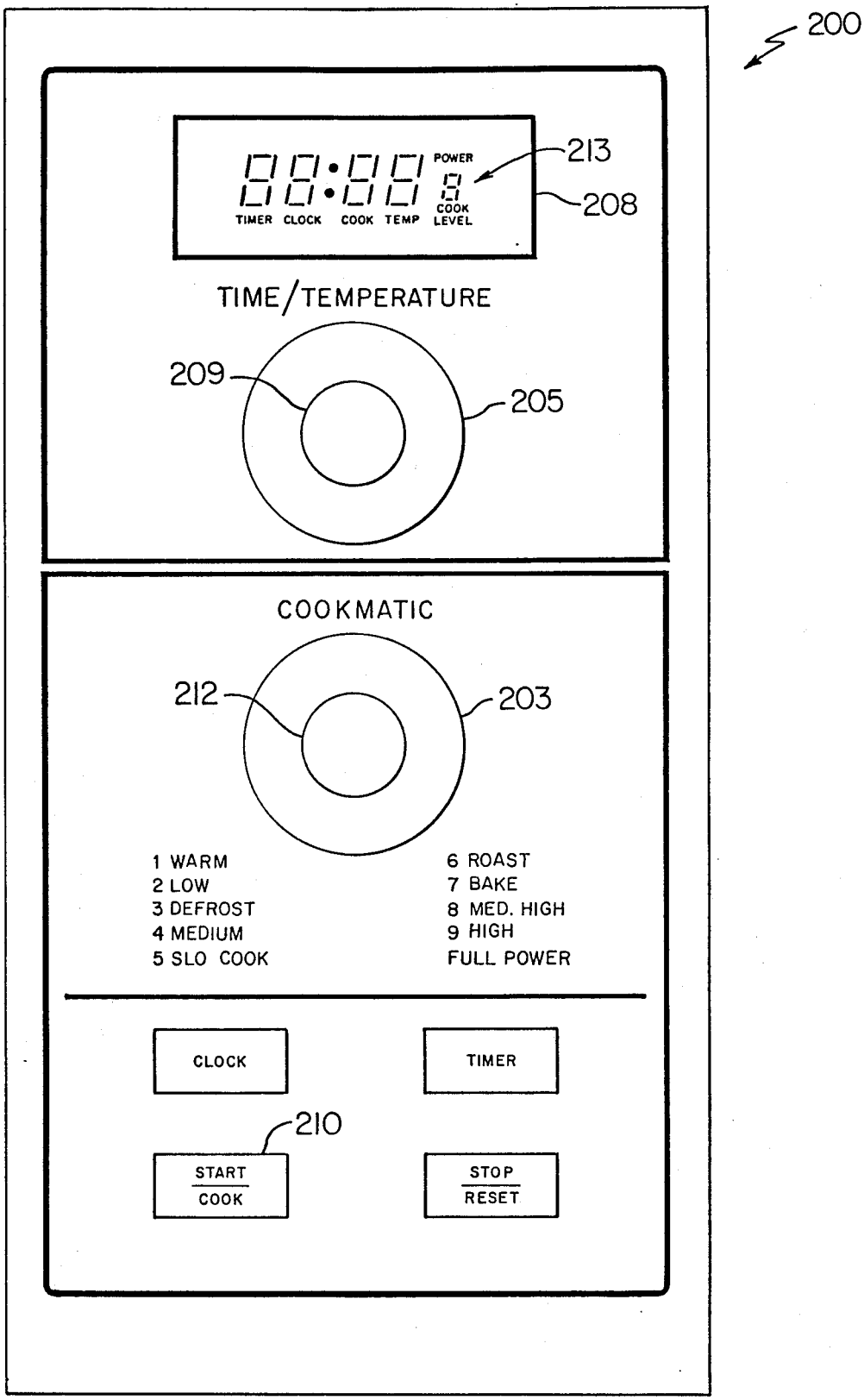
FIG. 1 is a front view of the new electrically operated control device of this invention.

While the various features of this invention are hereinafter illustrated and described as being particularly adapted to provide a control device and system for a particular electrical circuit means for a microwave oven, it is to be understood that the various features of this invention can be utilized singly or in various combinations thereof to provide an electrically operated control device and system for other electrical circuits for microwave ovens as desired.

Therefore, this invention is not to be limited to only the embodiment illustrated in the drawings, because the drawings are merely utilized to illustrate one of the wide variety of uses of this invention.

Figures 16A, 17:
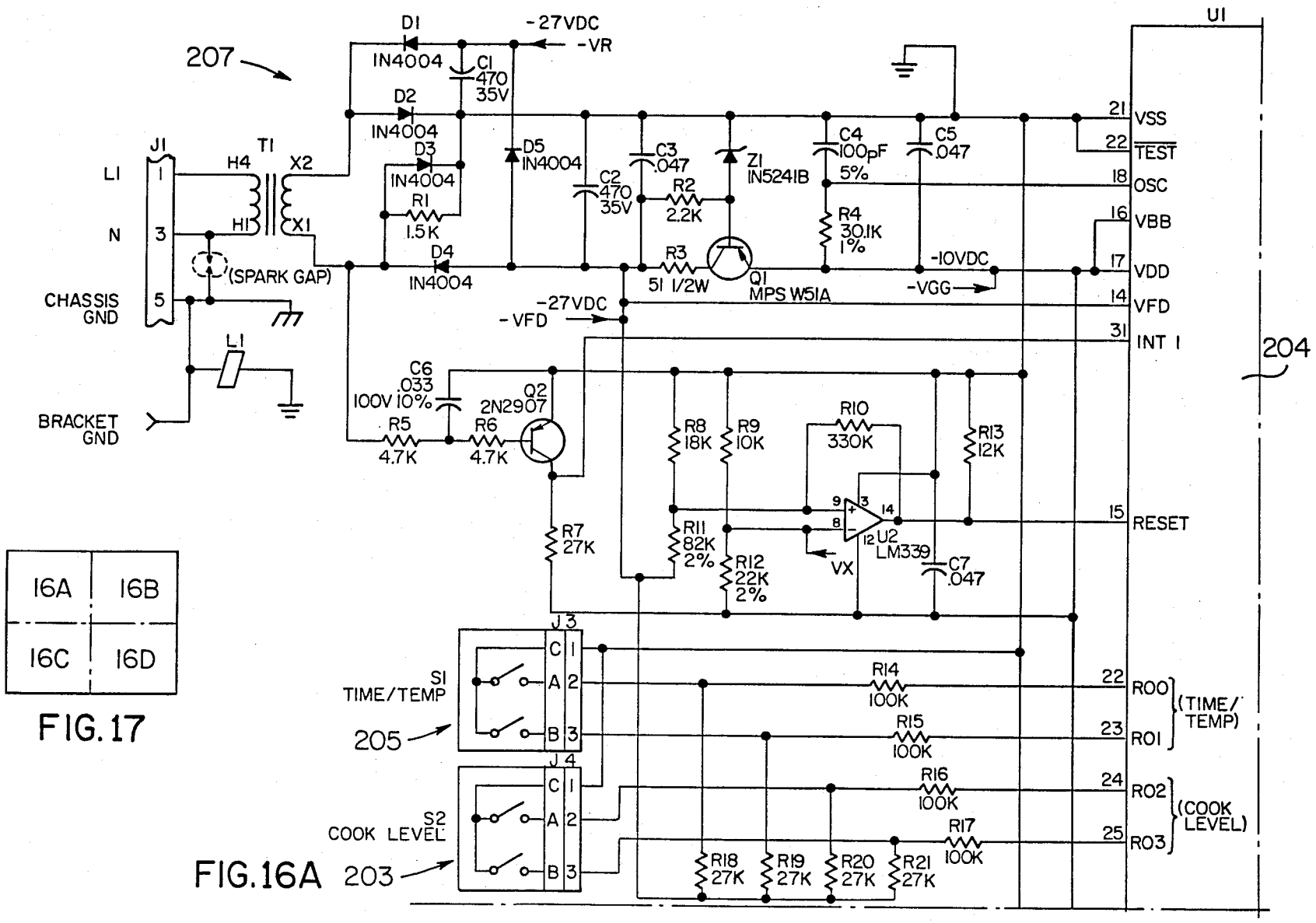
FIG. 16A is a schematic view of part of the electrical circuit of the control device of FIG. 1.
FIG. 17 is a block diagram illustrating how
Figure 16B:
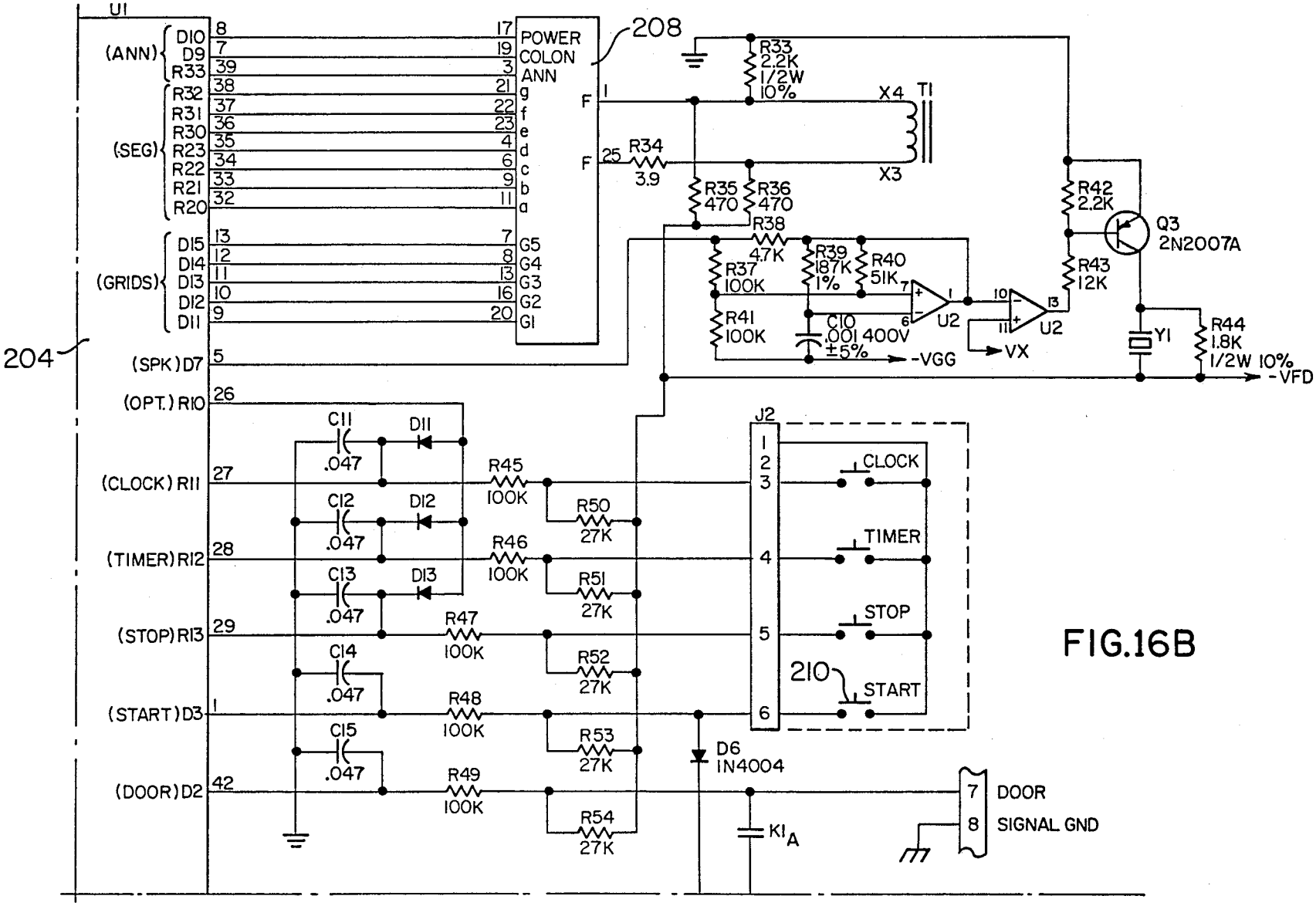
FIG. 16B is another part of the electrical circuit of the control device of FIG. 1.
Figure 16C:
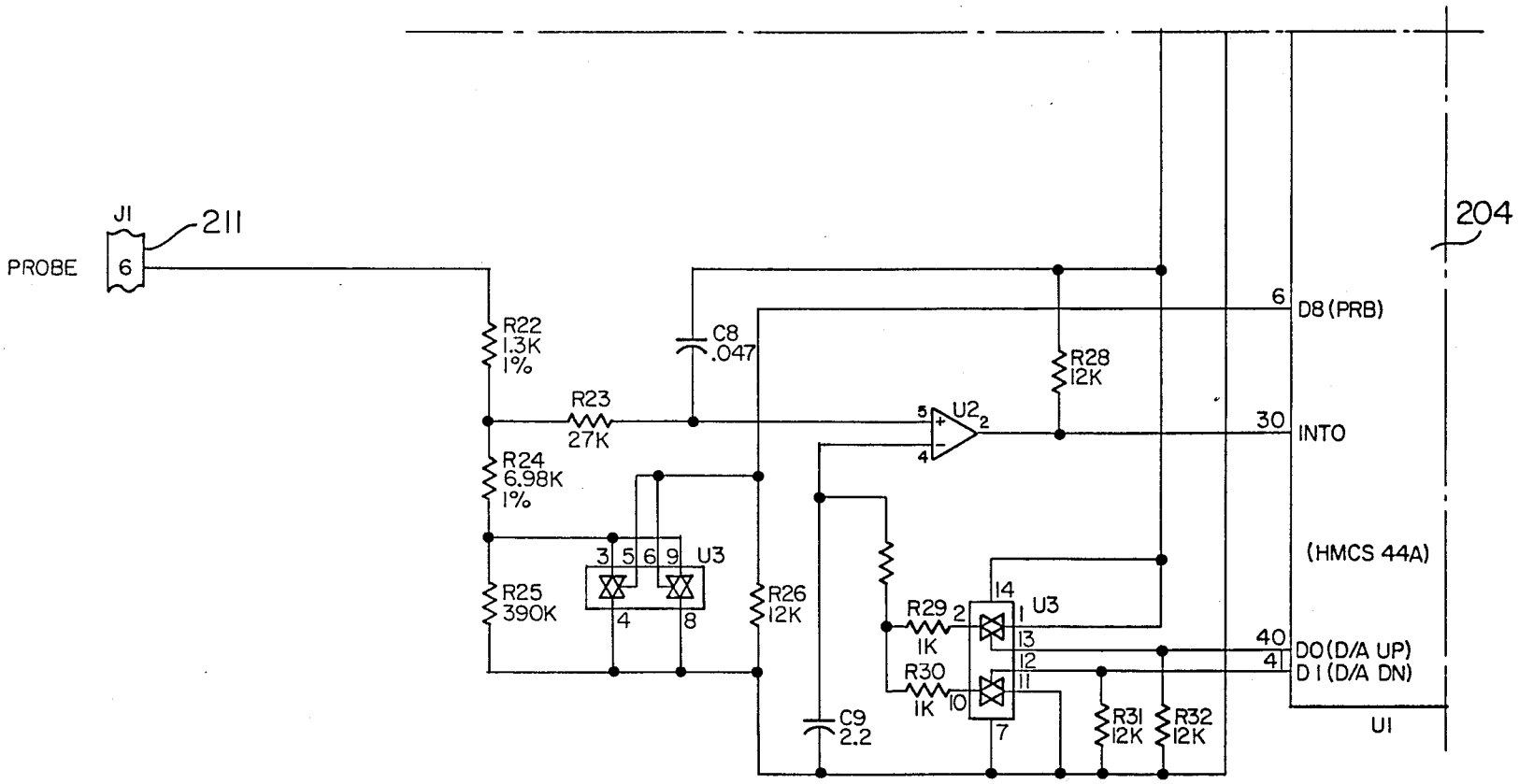
FIG. 16C is another part of the electrical circuit of the control device of FIG. 1.
Figure 16D:
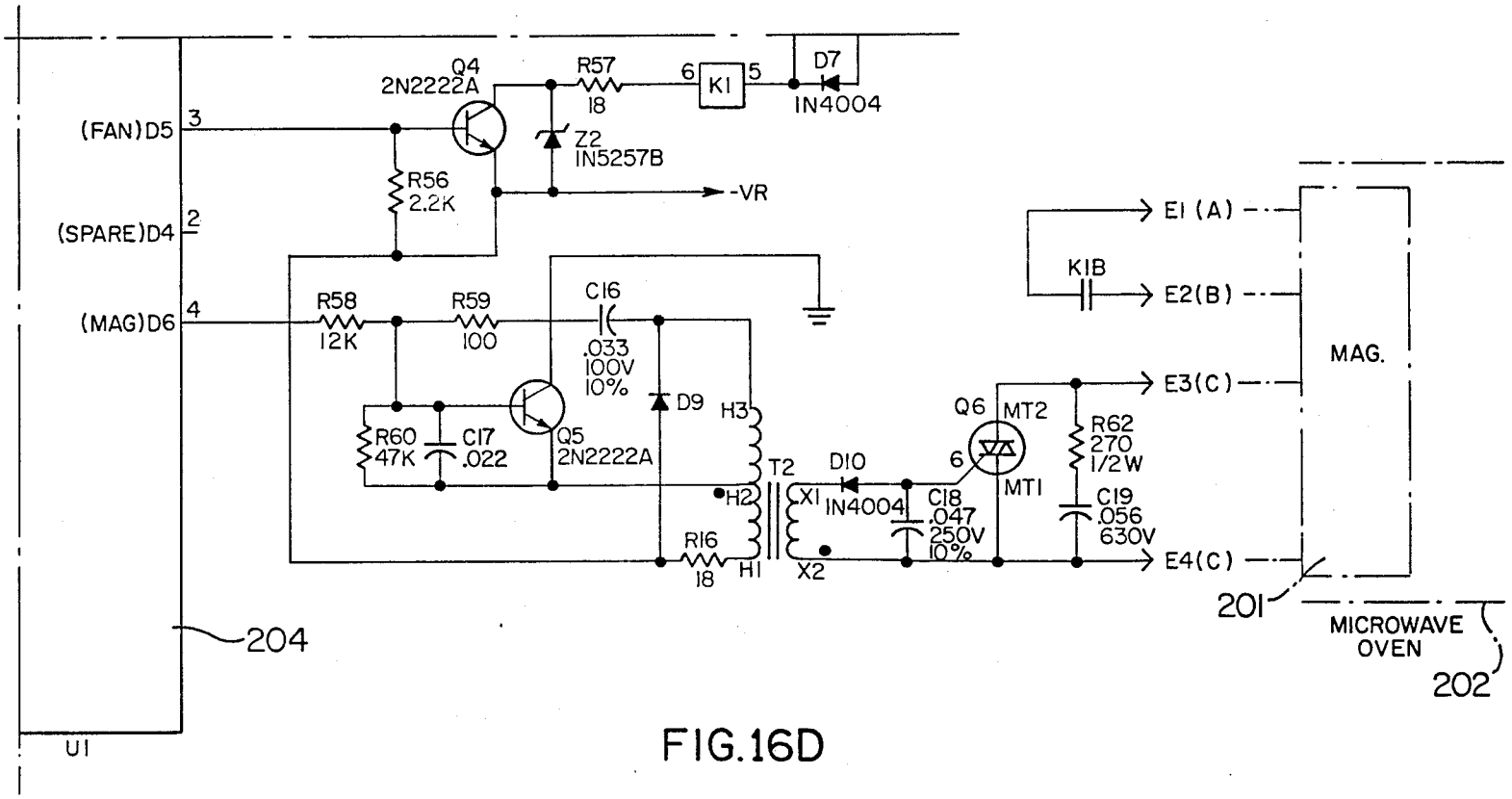
FIG. 16D is another part of the electrical circuit of the control device of FIG. 1 and further illustrates schematically the microwave oven and power means therefor that is operated by the control device of FIG. 1.

Referring now to FIG. 1, the new control device of this invention is generally indicated by the reference numeral 200 and is illustrated as controlling the power means 201, FIG. 16D, of a microwave oven that is schematically illustrated by the reference numeral 202 in FIG. 16D.

The control device 200 has a first selector means 203 for selecting a desired power level that a microprocessor 204, FIG. 16A–16D, is to operate the power means 201 and a second selector means 205 for selecting a desired time period that the microprocessor 204 is to operate the power means 201 at the power level that is selected by the first selector means 203, the first and second selector means 203 and 205 each comprising a rotary switch means that is substantially identical to the other rotary switch means as will be apparent hereinafter, the rotary switch means being generally indicated by the reference numeral 206 in FIGS. 7–14 and being hereinafter described.

It is believed that in order to fully understand the new features of this invention, sufficient details of the structure and operation of the prior known control device of the aforementioned copending patent application Ser. No. 433,684 filed Oct. 12, 1982, now U.S. Pat. No. 4,568,927 will now be set forth. However, since the complete disclosure of copending patent application, Ser. No. 433,684, filed Oct. 12, 1982, has been published on Apr. 23, 1984 as European patent application publication No. 0,109,182, this European patent application publication No. 0,109,182 is being incorporated into this disclosure by this reference thereto.

FIGS. 2–5 illustrate the prior known solid state rotary entry control system, generally designated 10, and particularly adapted for use in controlling the microprocessor based appliance control, generally designated 12, only portions of which are illustrated. The microprocessor based appliance control 12 includes a conventional microprocessor U1 which may be of any desired type and the control 12 is adapted to control a microwave oven.

The solid state rotary entry control system 10 includes a rotary switch SW1 which is utilized to increment and decrement data into the microprocessor U1. The rotary switch SW1 includes a circular disc 14 which is mounted for rotation in a housing 15, the disc 14 being fixed to a shaft 16 mounted for rotation in suitable bearings carried by the housing 15. An actuating knob 18 is fixed to the outer end of the shaft 16 to facilitate manual rotation of the shaft 16 and the disc 14. The rotary disc 14 is provided with a code pattern that is uniquely decoded to determine whether or not the shaft 16 and the disc 14 are being angularly displaced in a clockwise or counterclockwise direction, the code pattern having a multiplicity of outputs for each 360 degrees of rotation of the shaft 16. The code pattern provides for forty distinct codes for each 360 degree rotation of the shaft 16 of the rotary switch SW1. The rotary switch SW1 is provided with a code pattern comprised of two concentric, segmented and electrically interconnected tracks SWA and SWB and a concentric continuous track SWC, each of the concentric tracks SWA and SWB having a fifty percent duty cycle of contact material versus insulation material. The pattern of the tracks is divided into four reference areas as a repeating type pattern with a total of forty reference areas in the embodiment of the invention illustrated. The output of each track SWA and SWB during angular rotation thereof provides a code pattern having two reference areas of electrically conducting material followed by two reference areas of nonconducting or insulating material. The two tracks SWA and SWB are related to each other in that the track SWA is offset from the track SWB by one reference area. With such a construction, if the code pattern is angularly moved, for example, in a clockwise direction as viewed in FIG. 4, first one track (SWA) will conduct while the second track (SWB) is in a nonconducting condition, then both tracks SWA and SWB will conduct after which the first track SWA discontinues conducting while the second track SWB continues to conduct. The pattern then moves to a position where neither track SWA nor track SWB conducts. The pattern then repeats itself for nine more phases.

It will be understood that the number of incrementing phases for each complete rotation of the shaft 16 is dependent on the number of on and off patterns incorporated in 360 degrees. For example, if there are ten on and off patterns for each 360 degree rotation of the pattern, there is a four to one multiplication and consequently there are forty distinct codes for each complete 360 degree rotation of the pattern. The switch SW1 includes wiper contacts 20A, 20B and 20C, the wiper contacts 20A and 20B being adapted to contact the code patterns provided by the tracks SWA and SWB while the wiper contact 20C is adapted to contact the concentric continuous track SWC and is connected to ground throughout the rotation of the track patterns. Since the code patterns are offset, the wiper contacts provide means for determining the direction of rotation of the shaft 16 depending upon whether the first track SWA or the second track SWB first changes from a conducting to a nonconducting condition. As will be discussed hereinafter in greater detail, the code pattern emitted by the switch SW1 is supplied to the microprocessor U1 in the form of a digital code to increment and decrement data, such as time and temperature, into the microprocessor U1.

Figure 5:
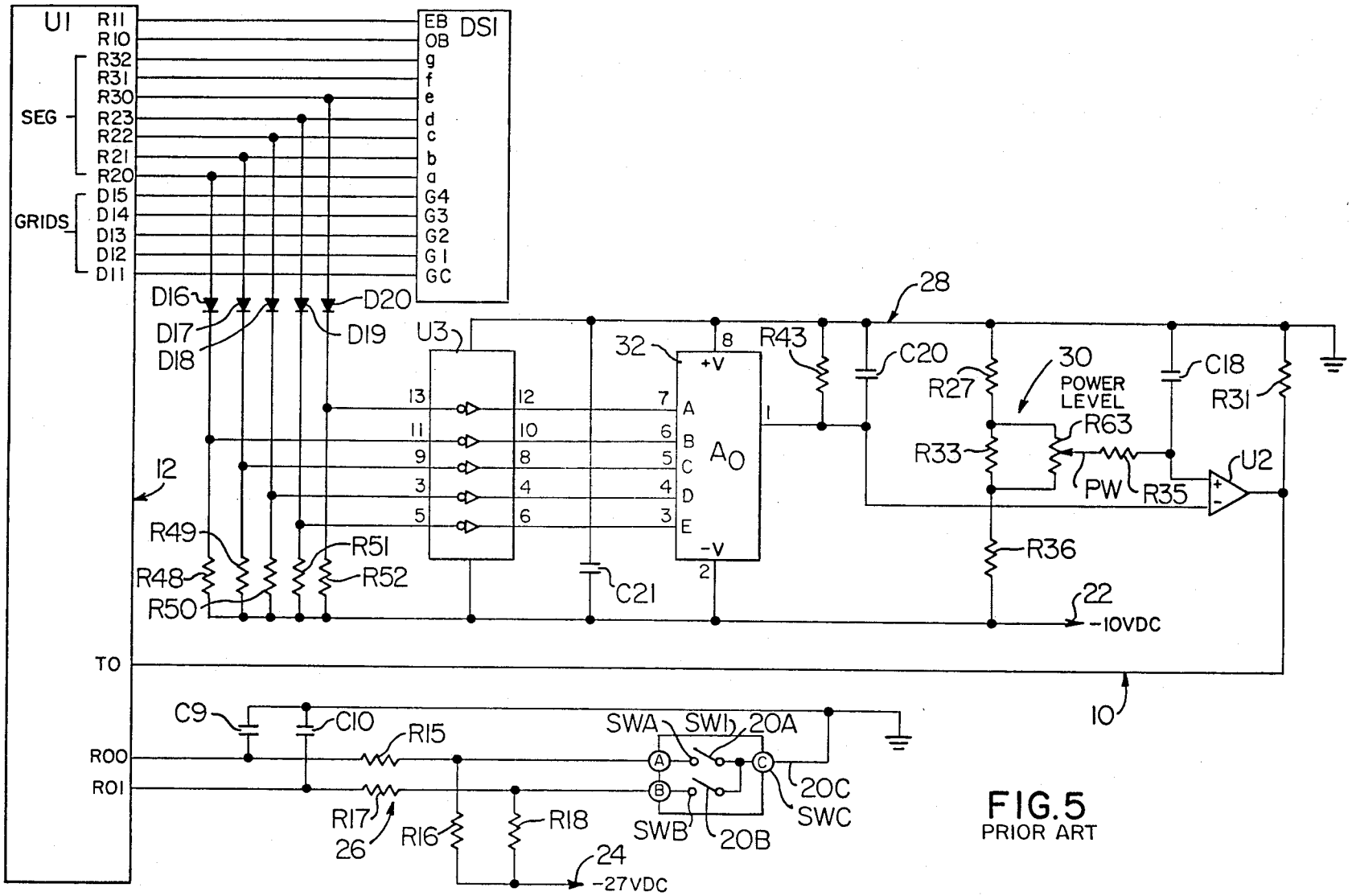
FIG.5 PRIOR ART
FIG. 5 is a schematic view illustrating the electrical circuit of the control device of FIG. 2.

Referring to FIG. 5, the solid state rotary entry control system 10 is adapted to be connected to conventional power supplies, such as the minus ten volt DC power supply 22 and the minus 27 volt DC power supply 24 supplied by any desired or conventional means incorporated in the appliance control 12. The system 10 is comprised of a rotary switch circuit, generally designated 26, which includes the rotary switch SW1. The rotary switch circuit 26 also includes resistors R15, R16, R17, and R18; and capacitors C9 and C10, the various components of the rotary switch circuit 26 all being electrically connected by suitable conductors, as illustrated in FIG. 5, and as will be described hereinafter in greater detail.

In addition, the system 10 includes a power level circuit, generally designated 28, comprised of a conventional rotary potentiometer 30 having an actuating knob 19, a comparator U2, a CMOS inverter U3, an R/2R ladder network 32, capacitors C18, C20 and C21, resistors R27, R31, R33, R35, R36, R43, R48, R49, R50, R51 and R52, the variable potentiometer resistor R63, and diodes D16, D17, D18, D19, D20. The various components of the power level circuit 28 are also all electrically connected by suitable conductors as illustrated in FIG. 5 and as will be described hereinafter in greater detail.

The rotary potentiometer 30 is scaled so that the D to A converter, comprised of the CMOS inverter U3, the R/2R ladder network 32, the resistor R43 and the capacitor C20, reads eleven steps or increments, that is to say, a zero percent to one hundred percent of rotation in ten percent increments. The rotary potentiometer 30 is a linear potentiometer, and a particular angular position of the rotary potentiometer corresponds to a specific step on the D to A converter.

Figure 2:
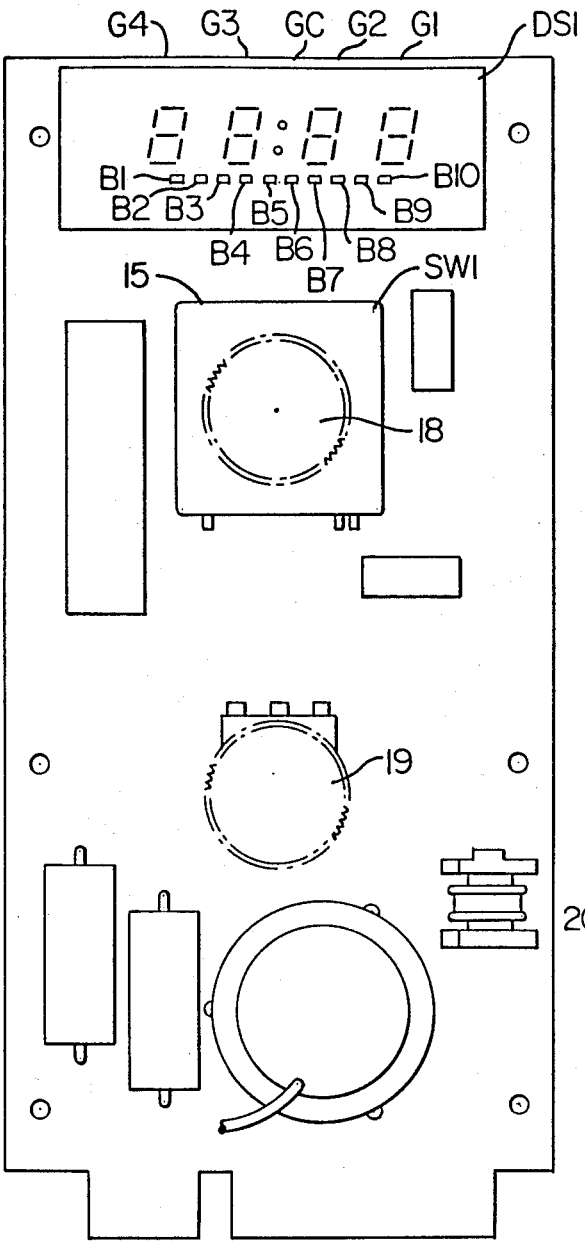
FIG. 2 PRIOR ART
FIG. 2 is a view similar to FIG. 1 and illustrates the prior known electrically operated control device of the copending patent application, Ser. No. 433,684, filed Oct. 12, 1982.
Figure 3:
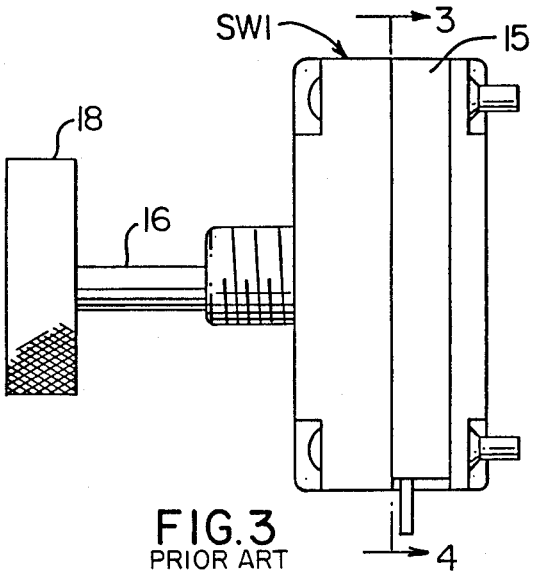
FIG. 3 PRIOR ART
FIG. 3 is an enlarged side view of the rotary switch means of the control device of FIG. 2.
Figure 4:
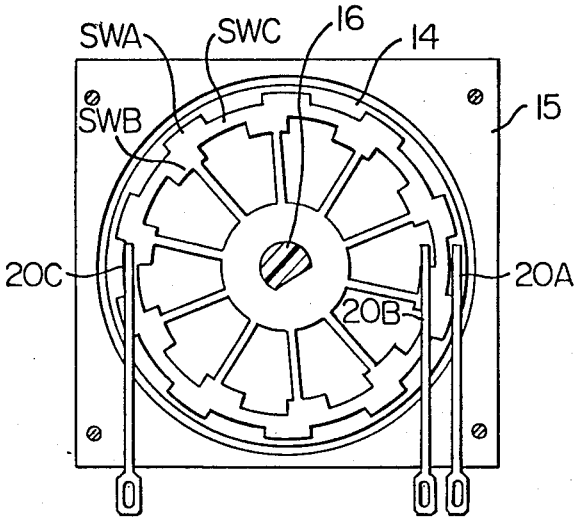
FIG. 4 PRIOR ART
FIG. 4 is a cross-sectional view taken on line 4—4 of FIG. 3.

The microprocessor U1 is programmed to supply signals to a multiplexed vacuum fluorescent Arabic numeral display DS1, the display also including ten bars B1 through B10 in a horizontal pattern across the bottom of the display as illustrated in FIG. 2, the percentage of bars displayed corresponding to the percentage of rotation of the rotary potentiometer 30 which controls the power level of a high energy component of the appliance being controlled, such as the power level of the magnetron 201 of the microwave oven 202 of FIG. 16D. Each increment of rotation of the rotary potentiometer will light a successive bar on the display whereby the display reading corresponds with the angular position of the rotary potentiometer 30, and at the same time a corresponding duty cycle is entered for the magnetron corresponding to the percentage displayed on the bar graph. The magnetron is preferably duty cycled on and off to a predetermined time base such as, for example, fifteen seconds. That is to say, with a fifty percent duty cycle, the magnetron is energized for approximately 7.5 seconds and deenergized for approximately 7.5 seconds, suitable provisions being made to compensate for magnetron warm up time.

In general, the rotary potentiometer 30 is scaled to match the D to A converter by the resistors R27, R33 and R36. The junction point or node between the resistors R27 and R33 corresponds to step number eleven of the D to A converter, and the voltage junction pint or node of the resistors R33 and R36 corresponds to the D to A converter step number one. Since the potentiometer wiper PW is moved in a linear displacement angular motion, all of the voltage steps between step number one and step number eleven can be adjusted for. The potentiometer wiper PW is fed into the positive input of the comparator U2. The negative input on the comparator U2 is fed from the D to A converter, the D to A converter being a stair case generator, and the stair case that emanates from the D to A converter is digitally encoded. Digital step number one is output from the microprocessor U1, and the ladder network 32 will provide a corresponding analog voltage that corresponds to a digital step number one. When the potentiometer wiper Pw of the rotary potentiometer is at a position that compares in an analog fashion to the ladder step for number one, a comparison is provided through the comparator U2. The microprocessor U1 is programmed to send out digital codes and to compare these codes to the analog position of the rotary potentiometer wiper PW. The microprocessor U1 is programmed to determine where the potentiometer wiper PW is located in any of the eleven positions or steps on the wiper of the rotary potentiometer 30. Since the microprocessor U1 is sending out a predetermined code and is programmed to discriminate as to where the wiper of the rotary potentiometer is located, the microprocessor U1 utilizes such information and presents it as a bar graph on the display DS1.

Figure 6:
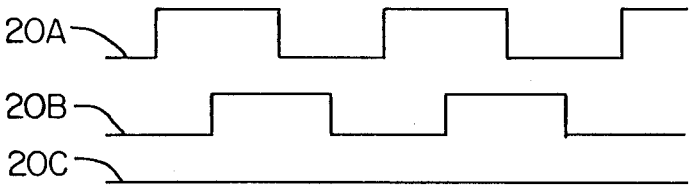
FIG. 6 PRIOR ART
FIG. 6 is a logic timing diagram illustrating the position of the rotary switch means of FIGS. 3 and 4.

In the operation of the system 10, as the pulses emanating from the switch SW1 are sent into the microprocessor U1, inputs R00 and R01, the microprocessor examines the states of two inputs R00 and R01 and analyzes those states based on the previous reading that the microprocessor did on those two inputs. Based on the current state versus the last state that was read by the microprocessor on the inputs R00 and R01, the microprocessor determines whether the rotary switch SW1 was operated in a clockwise direction or a counterclockwise direction. The anner in which the states change and the manner in which the microprocessor interprets the change of states of the inputs R00 and R01 is as follows: the input R00 is connected to the switch contact 20A while the input R01 is connected to the switch contact 20B. If the rotary disc 14 is being operated in a clockwise direction, as viewed in FIG. 3, then the logic state of the contact 20A will change to a new state prior to a change of the logic state of the contact 20B. In other words, if the contact 20A goes positive, then contact 20B will go positive in the next state after which contact 20A will go back in the negative state, and in the next position the contact 20B will go back to the negative state, there being a repetitive operation after every four logic state changes. If the disc 14 is being rotated in a counterclockwise direction, then the contact 20B changes its logic state before the contact 20A changes its logic state. That is to say, if both states of the contacts 20A and 20B are negative, then contact 20B will go positive after which the contact 20A will go positive. In the next state, the contact 20B will go negative after which the contact 20A will go negative. In summary, in a clockwise direction, the contact 20A's logic state will lead the contact 20B's logic state. In the counterclockwise direction, the contact 20B's logic state will lead the contact 20A's logic state. The pattern of the successive conducting and nonconducting states of the contacts 20A and 20B and the continuous conductivity of the contact 20C is illustrated in FIG. 6 of the drawings. It will be understood that it is not critical as to which track SWA and SWB and the associated contacts 20A and 20B leads or follows, it being merely necessary that one track lead or follow the other track.

As previously mentioned, the signals coming into the inputs R00 and R01 are analyzed by the microprocessor U1, and the microprocessor utilizes such information to control the time and/or temperature of operation of the associated appliance. In addition, the microprocessor U1 interfaces with the display DS1 which, as previously mentioned, is a multiplexed vacuum flourescent Arabic numeral display. The display DS1 includes five digit grids, four of which have conventional seven segment Arabic numeral displays which may be utilized, for example, to form a FIG. 8 in the conventional manner. The other grid is a colon grid disposed between the second and fourth numeral displays. In addition, the display DS1 includes the bar graph segments B1 through B10 disposed below the numerals in the embodiment of the invention illustrated. With such a construction, the display DS1 is utilized to display the time or temperature to the user of the appliance and the display is also utilized to display a bar graph indicative, for example, of a power level selected by the user of the appliance.

As previously mentioned, the rotary switch SW1 has three terminals 20A, 20B and 20C, the common terminal 20C being connected to ground of the control, which is zero volts DC. The switch terminal 20A is connected to the pull down resistor R16, the other side of the resistor R16 being connected to the source 24 of minus 27 volts DC. The switch terminal 20A is alsoc onnected to the resistor R15, the other side of the resistor R15 being connected to the input port R00 of the microprocessor U1. As shown in FIG. 5, the input port R00 is also connected to one side of the capacitor C9 while the other side of the capacitor C9 is tied back to ground which is zero volts DC. The contact 20A, when it is open, then sees a potential of minus 27 volts DC which is derived through the pull down resistor R16 that is tied to the source 24 of minus 27 volts DC. The minus 27 volts DC at the contact 20A is fed through the resistor R15 to the input port R00 of the microprocessor U1. The resistor R15 and the capacitor C9 act as an RC filter that is used to filter out transients. The RC filter comprised of the resistor R15 and the capacitor C9 is also used to filter out switch bounce which is caused by the mechanics of the switch oscillating from the open to closed state and the closed to open state. The amount of filtering that the resistor R15 and capacitor C9 provides must be less than the mechanical square wave generation provided by a person rotating the switch SW1 as illustrated in FIG. 5 of the drawings, so that the square wave pulses can be sensed at the input R00 of the microprocessor U1. It will be understood that the RC filter comprised of the resistor R15 and the capacitor C9 only shapes the wave form rather than totally filtering it out. The switch terminal 20B interfaces to the resistors R17 and R18 at one point, the other side of the resistor R18 being connected to the source 24 of minus 27 volts DC, the resistor R18 being a pull down resistor for the switch contact 20B. The resistor R17 and the capacitor C10 also provide an input filter network for the switch contact 20B in the same manner that the resistor R15 and the capacitor C9 provide an RC filter for the switch contact 20A. When the switch contact 20B is open, minus 27 volts DC is provided on the switch contact 20B and when the switch contact 20B is closed, zero volts DC is connected to the switch contact 20B. These logic levels are then sent through the resistor R17 to the input port R01 of the microprocessor U1. The terminals 20A and 20B thus provide logic states that vary between zero volts DC and minus 27 volts DC, and the pattern that is generated on the terminals 20A and 20B as the tracks SWA and SWB are rotated is fed to the input ports R00 and R01 of the microprocessor U1. The microprocessor U1, in turn, analyzes these logic states and determines whether the switch is stationary or whether it has been rotated in a clockwise or counterclockwise direction. Such information is then utilized to increment or decrement the time or temperature for operating the associated appliance, the time or temperature also being displayed on the display DS1. The scanning rate of the inputs R00 and R01 is such that the microprocessor U1 will monitor the rotation of the rotary switch SW1 even if a person rotates the switch very rapidly. In the event that the microprocessor U1 does miss state changes, which is a possibility if a person rotates the switch SW1 extremely rapidly so that the RC filter comprised of the resistor R15 and the capacitor C9 for the terminal 20A completely filters out the switch signals, the logic inside of the microprocessor U1 simply ignores the inputs to the inputs R00 and R01 and maintains the previous reading.

As previously mentioned, the microprocessor U1 analyzes the signals emitted from the rotary switch and utilizes such information to control the entry of time and/or temperature data which is displayed by the display DS1. The magnitude of the time data increments and decrements is variable and proportional to the magnitude of the data currently displayed and stored in the microprocessor. For example, in the embodiment illustrated, the magnitude of the time data increments and decrements is varied in accordance with the following table:

| CURRENT VALUE OF TIME DATA | TIME DATA INCREMENTS/ DECREMENTS |
|---|---|
| 00:00 through 02:00 | 00:05 |
| 02:00 through 10:00 | 00:10 |
| 10:00 through 20:00 | 00:03 |
| 20:00 through 99:00 | 01:00 |

On the other hand, in the embodiment illustrated, the magnitude of the temperature data increments and decrements is preferably constant, as for example, increments and decrements of five degrees F from 100 degrees F through 190 degrees F.

In the operation of the power level circuit 28, the power level position is established by the rotary potentiometer R63 and the resistor network comprised of the resistors R27, R33 and R36. The rotary potentiometer R63 is in parallel with the resistor R33. The resistor network comprised of the resistors R27, R33 and R36 is used to establish the voltages of the two end stops of the rotary potentiometer, that is the full clockwise position and the full counterclockwise position. By establishing these voltages, the potentiometer is then scaled to correspond to a specific step of the D to A converter for a full counterclockwise position which corresponds to a voltage level that is used as the timer position on the potentiometer input while the full clockwise position has another distinct voltage that corresponds to one hundred percent power level. The full counterclockwise position of the potentiometer then provides a voltage that is less then the step of the D to A converter that corresponds to the timer input while the voltage at the full clockwise position is greater than one hundred percent of the power level. Thus, with the potentiometer in the full counterclockwise position, the timer mode may be set through the rotary switch SW1. With the rotary potentiometer in the full counterclockwise position, the magnetron does not turn on and all of the high energy circuits are inhibited.

As the rotary potentiometer is rotated in a clockwise direction, the setting of the power level of the magnetron is initiated. There are eleven power levels ranging from zero through one hundred percent in ten percent increments, that is to say, there is a zero level, a ten persent level, a twenty percent level, on through to a one hundred percent level providing eleven distinct settings or steps. These levels are determined by the analog voltage on the wiper PW of the rotary potentiometer R63 which is fed into the positive input of the comparator U2. That analog level is compared to the D to A converter's staircase which is fed to the negative input of the comparator U2 from the ladder network 32, pin 1. The outputs generated by the microprocessor U1 provide the address that is fed to the CMOS inverter U3. The address emitting from the CMOS inverter U3 to the ladder network 32 in turn generates the staircase steps. The microprocessor U1 is aware of the address that it is generating and the comparator U2 compares the D to A level of that address to the level of the wiper PW of the power level potentiometer 30. When the comparator U2 logic level indicates that the D to A step is greater than the power level position, the microprocessor utilizes such information to determine the power level. After the microprocessor U1 determines what the power level is, then the display sequence is initiated utilizing the output ports R10 and R11 of the microprocessor U1 which are connected to the odd and even bars of the display. The display is then strobed so that the microprocessor presents the information as a user enunciation of the power level that was selected. A continuous readout of the position of the power level potentiometer 30 is always presented whenever the microprocessor is in the mode that presents such information to the user.

It will be understood that all of the odd bars B1, B3, B5, B7 and B9 are connected together and that all of the even bars B2, B4, B6, B8 and B10 are connected together. There are two segments in each of the grids of the display, and the odd bars and even bars for a particular grid are lighted in a sequential manner. For example, assuming that there is a fifty percent power level, the odd and even bars of grid G4 of the display, (the left grid of the display as viewed in FIG. 1) the odd and even bars of grid G3 of the display, and the odd bar of the colon grid Gc of the display would be lighted. These bars are lighted sequentially as the display is strobed, the grids of the display being strobed from left to right. As previously mentioned, the display is multiplexed so that the time and temperature as well as the bar graph may be displayed, the material of the display segments having a persistence such that the eye of a user thereof perceives the display as glowing continuously.

The biasing network for the rotary potentiometer starts at signal ground, and from signal ground, one side is tied to the resistor R27, the other side of the resistor R27 being tied to one side of the resistor R33. The other side of the resistor R33 ties to one side of the resistor R36 and the other side of the resistor R36 ties to the source of potential 22 which is minus ten volts DC. The potentiometer resistance R63 is in parallel with the resistor R33. The wiper PW of the potentiometer 30 is connected to one side of the resistor R35 which is part of an RC filter. The other side of the resistor R35 is connected to the positive pin of the comparator U2. Such side of the resistor R35 is also connected to one side of the capacitor C18 while the other side of the capacitor C18 is connected to signal ground. Thus the resistor R35 and the capacitor C18 form an RC network filter that prevents transients, such as static discharge, from affecting the comparator U2. Such RC network does not attentuate the DC level that is on the wiper PW of the rotary potentiometer. As previously mentioned, the resistors R27, R33 and R36 are used to scale the end points of the potentiometer resistance R63 whereby such scaling provides eleven positions on the potentiometer that compare to the steps of the D to A output of the ladder network. The D to A output is generated by the ladder network 32, output pin 1. The ladder network 32 generates a staircase that is binary weighted, the binary address being generated by the microprocessor U1.

The outputs R20, R21, R22, R23 and R30 of the microprocessor U1 provide a binary address generated by the microprocessor U1. This information is interfaced to the CMOS inverter U3 through the diodes D16, D17, D18, D19 and D20, such diodes being utilized as part of the level transition. It should be noted that the cathod sides of the diodes D16, D17, D18, D19 and D20 are tied to the pull down resistors R48 R49, R50, R51 and R52, respectively, the pull down resistors in turn being connected to the source 22 of the minus ten volts DC. Thus, if the microprocessor is emitting minus 27 volts DC, the diodes block the minus 27 volts DC from the inputs of the CMOS inverter U3. The resistors R48 through R52 pull the inputs of the CMOS inverter U3 down to a minus ten volts DC whereby a level translation is provided from logic that is from zero to minus 27 volts DC to logic that is from zero to minus ten volts DC.

The binary address from the CMOS inverter U3 is interfaced to the ladder network 32. The CMOS inverter U3 sources and sinks the current to the positive and negative potential of the power supply between zero volts DC and minus ten volts DC. The ladder network inputs A through E sum the currents from the CMOS inverter U3 and generate an analog staircase which is proportional to the binary address from the CMOS inverter U3. This output is generated at pin 1 of the ladder network 32. The output of the ladder network 32 then is interfaced to the negative input of the comparator U2. This analog staircase is then compared to the analog potential coming from the wiper PW of the rotary potentiometer 30. The microprocessor U1 senses the output of the comparator U2 and since the microprocessor U1 knows what the potential of the analog staircase is, the microprocessor U1 is able to determine what the potential of the wiper PW of the power level potentiometer 30 is.

The resistor R43 is a bias resistor that is used to adjust the slope of the analog staircase while the capacitor C20 is a filter capacitor that is used to filter out any switching transients that are caused by switching from address to address, i.e., filtering the output of the ladder network 32. The capacitor C21 is a bypass capacitor that is across the minus ten volt power supply and is provided for noise immunity purposes.

An identification of and/or typical values for the components of the system 10, which are described hereinabove, are as follows:

| | |
|---|---|
| U1 | Microprocessor |
| U2 | Comparator |
| U3 | CMOS Inverter |
| 32 | R/2R Ladder Network |
| C9 | Capacitor, .01 mfd |
| C10 | Capacitor, .01 mfd |
| C18 | Capacitor, .01 mfd |
| C20 | Capacitor, 180 pF |
| C21 | Capacitor, .047 mfd |
| R15 | Resistor, 47K ohms |
| R16 | Resistor, 12K ohms |
| R17 | Resistor, 47K ohms |
| R18 | Resistor, 12K ohms |
| R27 | Resistor, 2.2K ohms |
| R31 | Resistor, 22K ohms |
| R33 | Resistor, 5.1K ohms |
| R35 | Resistor, 47K ohms |
| R36 | Resistor, 1.6K ohms |
| R43 | Resistor, 560K ohms |
| R48 | Resistor, 47K ohms |
| R49 | Resistor, 47K ohms |
| R50 | Resistor, 47K ohms |

-continued

| | |
|---|---|
| R51 | Resistor, 47K ohms |
| R52 | Resistor, 47K ohms |
| R63 | Rotary Potentiometer, 50K ohms |
| D16 | Diode, 1N4148 |
| D17 | Diode, 1N4148 |
| D18 | Diode, 1N4148 |
| D19 | Diode, 1N4148 |
| D20 | Diode, 1N4148 |
| DS1 | Vacuum Fluorescent Display |
| SW1 | Rotary Switch Shaft Encoder |

The control device 200 of this invention has the selector means 205 operate in substantially the same manner as the selector means 18 previously described except that the structure of the selector means 205 as illustrated in FIGS. 7–14 is of the type fully disclosed and claimed in the copending patent applicatin of Daniel L. Fowler et al, Ser. No. 676,440, filed Nov. 29, 1984 now U.S. Pat. No. 4,625,084, whereby this copending patent application is being incorporated into this disclosure by this reference hereto.

In addition, the selector means 203 of the control device 200 is substantially the same as the selector means 205 except that the selectormeans 203 does not have a position detent arrangement, although it is to be understood that the selector means 203 could have the same detent arrangement as the selector means 205.

Therefore, since the selector means 203 and 205 are substantially the same, it is to be understood that the following description of the rotary switch 206 of FIGS. 7–14 is a description that applies to either selector means 203 or 205.

Figure 7:
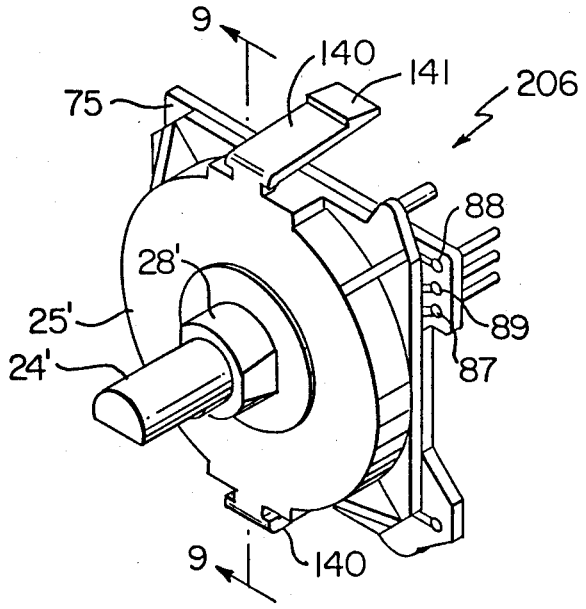
FIG. 7 is a perspective view of one of the rotary switch means of the control device of FIG. 1.
Figure 8:
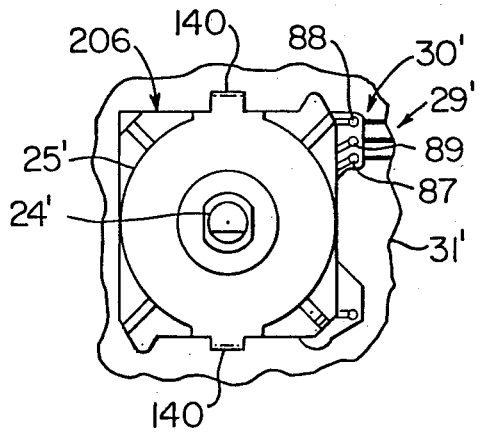
FIG. 8 is a fragmentary reduced front view of the switch means of FIG. 7 and illustrates the same mounted to a circuit board of the control device of FIG. 1.
Figure 9:
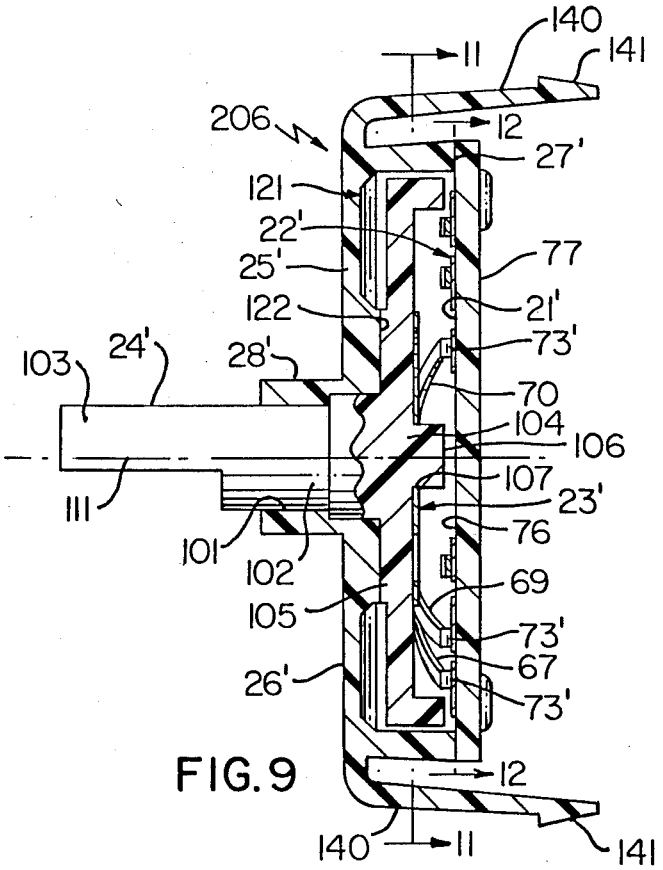
FIG. 9 is an enlarged cross-sectional view taken on line 9—9 of FIG. 7.

As illustrated in FIGS. 7–9, the rotary switch 206 comprises a surface means 21′ having a substantially circular electrically conductive code pattern 22′ thereon, an electrically conductive wiper contact means 23′ cooperating with the surface means 21′ for making contact with a selected part of the pattern 22′ in a manner hereinafter set forth, a rotary selector 24′ operatively associated with the surface means 21′ and wiper contact means 23′ for selecting the desired part of the pattern 22′ that is to be contacted by the wiper contact means 23′ in a manner hereinafter set forth, and a cup-shaped housing member 25′ that has a closed end 26′ and an open end 27′, the surface means 21′ being secured to the housing member 25′ in a manner hereinafter set forth and closing the open end 27′ thereof.

The housing member 25′ is formed of any suitable electrically insulating material and has means 28′ that rotatably mounts the rotary selector 24′ thereto, the rotary selector 25′ also being formed of any suitable electrically insulating material and being operatively interconnected to the wiper contact means 23′ to rotate the same relative to the surface means 21′ as the wiper contact means 23′ is disposed in the housing member 25′ intermediate the closed end 26′ thereof and the surface means 21′.

The wiper contact means 23′ is formed of any suitable electrically conductive material and is adapted to cooperate with the code pattern 22′ to increment and decrement information in a digital manner through the electrical switching operation thereof to supply such data to the control system that is generally indicated by the reference numeral 29′ in FIG. 8 and comprises a printed conductive circuit means 30′ being carried by an insulated board means 31′.

The control system 29′ of FIG. 8 comprises part of the control system or circuit means 207 of FIGS. 16A–16D of the control device 200.

The wiper contact means 23′ of the rotary switch construction 206 comprises a one-piece structure formed of metallic material and having a main body portion 65 and three pairs of wiper contacts formed integral therewith and extending therefrom in an arcuate manner.

In particular, the first pair of wiper contacts comprises the wiper contacts 66 and 67, the second pair of wiper contacts comprises the wiper contacts 68 and 69 and the third pair of wiper contacts comprises the wiper contacts 70 and 71.

Each wiper contact 66–71 has opposed ends 72 and 73, the ends 72 connecting the respective wiper contacts 66–71 to the body portion 65 of the wiper contact means 23′ while the other ends 73 thereof are arcuately formed so as to have the convex sides 73′ thereof engage against the code pattern 22′ on the surface means 21′ as will be apparent hereinafter.

Each wiper contact 66–71 has an arm or beam 74 interconnecting the opposed ends 72 and 73 together, each arm 66 being bowed or bent in a manner to provide a biasing or spring force urging the convex side 73′ of the end 73 thereof against the surface means 21′ so as to provide for good electrical contact between that end 73 and the code pattern 22′ as will be apparent hereinafter. Each arm 74 of each wiper contact 66–71 is arcuate in the sense that it defines an arc that is adapted to be superimposed on a particular circular path of the code pattern 22′ as will be apparent hereinafter.

Figure 11:
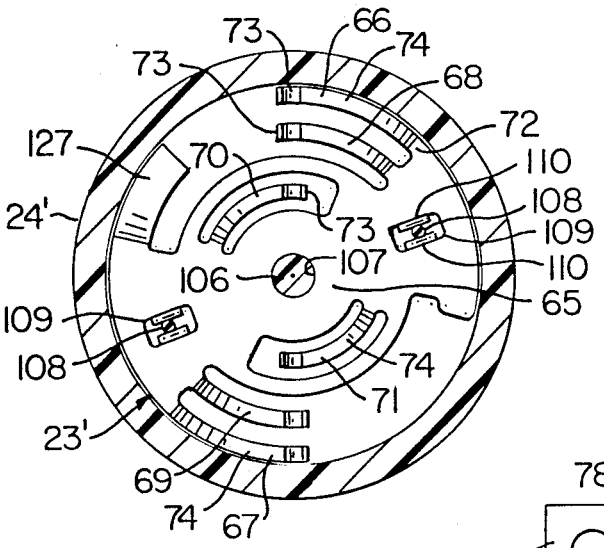
FIG. 11 is a reduced cross-sectional view taken on line 11—11 of FIG. 9.

While the wiper contact means 23′ can be formed in any suitable manner, the same can comprise a stamping from a blank of metallic material and have the configuration illustrated in FIG. 11 wherein the third pair of wiper contacts 70 and 71 extend in opposite directions relative to the first pair of wiper contacts 66 and 67 and the second pair of wiper contacts 68 and 69.

Also, it can be seen that each pair of wiper contacts 66, 67; 68, 69 and 70, 71 have the contact ends 73 thereof disposed to respectively contact the code pattern 22′ on respective substantially circular paths thereof at points thereon that are disposed approximately 180° from each other with the arms 74 of each pair extending in the opposite direction from the other arm 74 of that pair thereof for a purpose hereinafter set forth.

Figure 12:
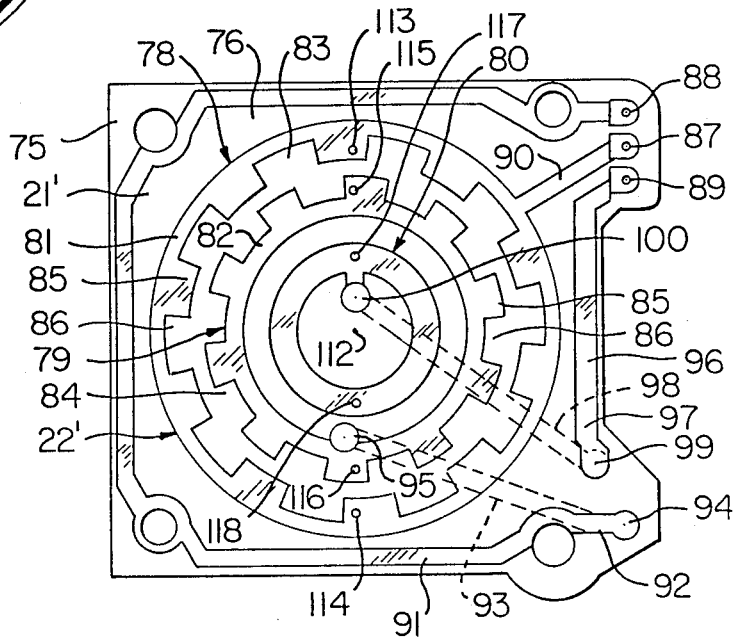
FIG. 12 is a reduced cross-sectional view taken on line 12—12 of FIG. 9.

The surface means 21′ of the rotary switch construction 206 comprises a substantially rigid board means 75 formed of any suitable electrically insulating material and having opposed substantially flat sides 76 and 77, the code pattern 22′ being disposed on the side 76 of the board 75 in any suitable manner and comprising three substantially circular and concentrically disposed, spaced apart paths or tracks that are generally indicated by the reference numerals 78, 79 and 80 as illustrated in FIG. 12.

The circular paths 78 and 79 each has a substantially circular continuous portion 81 and 82 and a discontinuous circular portion 83 and 84 respectively comprising a plurality of conductive segments 85 and nonconductive segments 86 in the serial arrangement illustrated in FIG. 12 whereas the circular path 80 of the code pattern 22′ comprises a continuous circular conductive path.

The board means 75 has three electrically conductive terminal pins 87, 88 and 89 adapted to be respectively electrically interconnected to the circular paths 78, 79 and 80.

In particular, the terminal pin 87 is electrically interconnected to the path 79 by a conductive strip 90 disposed on the side 76 of the board 75.

The terminal 88 is electrically interconnected to the circular path 79 by a conductive strip 91 disposed on the side 76 of the board 75 and having an end 92 electrically interconnected to a conductive strip 93 disposed on the other side 77 of the board 75 by an electrical conductor 94 that extends through the board 75. The conductive strip 93 on the side 77 of the board 75 is, in turn, electrically interconnected to the circular path 79 by a conductor 95 that extends through the board 75 whereby the terminal 88 is electrically interconnected to the conductive code path 79.

The terminal 89 is electrically interconnected to the circular path 80 by a conductive strip 96 disposed on the side 76 of the board 75 and having its end 97 electrically interconnected to a conductive strip 98 on the other side 77 of the board 75 by a conductor means 99 passing through the board 75. The conductive strip 98 is, in turn, electrically interconnected to the conductive circular path 80 by a conductor 100 passing through the board 75 as illustrated in FIG. 12.

It can be seen that the conductive projections 85 of the circular paths 78 and 79 are respectively offset relative to each other so that the same lead or trail each other in substantially the same manner as the conductive portions of the paths SWA and SWB of the prior known rotary switch construction SW1 and for the same purpose.

The cup-shaped housing means 25′ of the rotary switch construction 200 has a stepped bore 101 passing through the closed end wall 26′ thereof which telescopically receives a stepped shaft portion 102 of the rotary selector 24′ as illustrated in FIG. 9 so as to rotatably mount the selector 24′ thereto, the shaft means 102 having an end 103 for receiving a suitable control knob (not shown) and the other end 104 thereof comprising a disk-like part 105 that has a central reduced protrusion 106 adapted to be received through a circular opening 107 formed through the body portion 65 of the wiper contact means 23′ as illustrated in FIGS. 9 and 11. The disk-like portion 105 of the selector 24 has a pair of outwardly extending projections 108, FIG. 11, that project through suitable slots 109 in the body portion 65 of the wiper contact means 23′ so that rotation of the selector shaft 102 causes the wiper contact means 23′ to rotate in unison therewith through the drive action of the projections 108 of the disk means 105 on suitable bent tangs 110 of the wiper contact means 23′ that were formed during the stamping of the slot means 109 therethrough.

The rotary shaft 102 has an axis of rotation that is indicated by the reference numeral 111 in the drawings and that axis of rotation 111 substatnaily coincides with a center point 112 of the circular code pattern 22′ so that the wiper contact means 23′ is, in effect, rotated about the point 112 as will be apparent hereinafter.

When the wiper contact means 23′ is assembled with the rotary selector 24′ in the housing member 25′, the bent wiper contacts 66–71 are placed under compression between the disk 105 of the selector 24′ and the side 76 of the board 75 so that the ends 73 of the wiper contacts 66–71 have a spring force thereon urging the same into good electrical contact with the code pattern 22′ and maintaining that electrical contact with the code pattern 22′ as the wiper contact means 23′ rotates relative thereto upon rotation of the selector shaft 102 relative to the housing member 25'.

The ends 73 of the first pair of wiper contacts 66 and 67 are so constructed and arranged that the same respectively contact the circular portion 83 of the circular path 78 at points disposed approximately 180° from each other, such as represented by the points 113 and 114 in FIG. 12. Similarly, the second pair of wiper contacts 68 and 69 has the ends 73 thereof so constructed and arranged that the same contact the circular portion 84 of the circular path 79 at points thereon that are disposed approximately 180° from each other, such as represented by the points 115 and 116 in FIG. 12. Likewise, the third pair of wiper contacts 70 and 71 is so constructed and arranged that the ends 73 thereof contact the conductive portion 85 of the circular path 80 at points disposed approximately 180° from each other, such as represented by the points 117 and 118 in FIG. 12.

Therefore, it can be seen that the arms 74 of the first pair of wiper contacts 66 and 67 respectively define arcs that are substantially superimposed on the first circular path 79 at the circular portion 83 thereof and when rotated in a clockwise direction in FIG. 11 will be pulled across the code pattern 22 whereas when rotated in a counterclockwise direction in FIG. 11 will be pushed across the code pattern 22.

Similarly, the arms 74 of the second pair of wiper contacts 68 and 69 define arcs that are adapted to be substantially superimposed on the circular portion 84 of the circular path 79 with the ends 73 thereof being simultaneously pushed or pulled across the code pattern 22' depending upon the direction of rotation of the wiper contact means 23'.

Likewise, the arms 74 of the third pair of wiper contacts 70 and 71 define arcs that are substantially superimposed on the conductive circular portion 85 of the circular path 80 with the ends 73 thereof being disposed to be respectively pushed or pulled across the code pattern 22' depending upon the direction of rotation of the wiper contact means 23' except that the arm 74 of the wiper contact 70 extends in an opposite direction to the arms 74 of the wiper contacts 66 and 68 and the arm 74 of the wiper contact 71 extends in an opposite direction to the arms 74 of the wiper contacts 67 and 69.

In this manner, the arms 74 have been arranged such that two opposed sets of wiper contacts 66, 68 and 67, 69 are pulled across the surface 21' when the wiper contact means 23 is rotated in a clockwise direction in FIG. 11 while the opposed wiper contacts 70 and 71 are being pushed across the surface 21' whereas when the wiper contact means 23 is rotated in a counterclockwise direction in FIG. 11, the two opposed sets of wiper contacts 66, 68 and 67, 69 are pushed across the surface 21' while the opposed contacts 70 and 71 are pulled across the surface 21'. It is believed that this wiper contact action results in similar dynamic contact response when the selector shaft 102 is turned or rotated in either a clockwise or counterclockwise direction.

In particular, the code pattern emitted by the rotary switch construction 206 is dynamically a function of shaft rotation as the wiper contacts make and break with their respective paths or tracks of the conductive code pattern. Such a mechanical interface has limitations and application issues that must be considered, such as contact bounce when contacts make and break with the conductive code pattern. Contact electrical noise which is contact resistance variations as the contact moves across the conductive code pattern is also an issue to be considered. The magnitude of these parameters have been greatly reduced in the rotary switch construction 206. For example, a major improvement is inherent in the wiper contact means 23' thereof. The wiper contact means 23' provides two sets of wiper contacts 66, 67; 68, 69 and 70, 71 which simultaneously interface with the code pattern tracks or paths 78, 79 and 80 and this produces a parallel switching function that greatly reduces contact bounce. The parallel switching function is believed to also reduce electrical contact noise and/or contact resistance variation as the wiper contacts travel across the conductive surface of the code pattern tracks or paths 78, 79 and 80 whereby code dropouts have almost been eliminated. It is also believed that the length of each of the contact arms 74 of the wiper contacts 66–71 of the rotary switch construction 206 have about the same length and have the same contact force which results in similar dynamic contact response which has been optimized for low contact bounce and dynamic tracking of the code pattern surface to reduce such dropouts.

Figure 10:
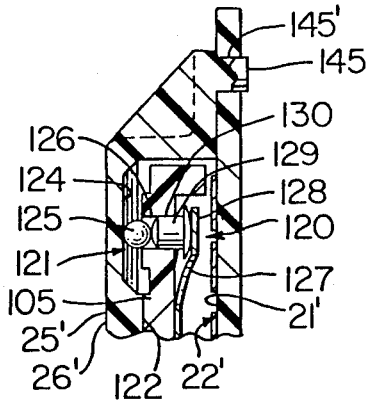
FIG. 10 is a fragmentary, cross-sectional view taken on line 10—10 of FIG. 13 and illustrates the detent means of the rotary switch means of FIG. 7.

The rotary switch construction 206 has a mechanical detent means that is generally indicated by the reference numeral 120 in FIG. 10 and which is adapted to synchronize manual rotation of the selector shaft 102 to the code pattern 22' through mechanical "feel".

In particular, the detent means 120 comprises a circular detent tooth pattern 121 formed in the inside surface 122 of the closed end wall 26 of the housing member 25, the tooth pattern 121 comprising V-shaped teeth 123 that define V-shaped grooves 124 therebetween and in which a detent ball 125 is adapted to be received. The ball 125 is partially disposed in a cylindrical opening 126 formed through the disk portion 105 of the rotary shaft 102 and is urged toward the detent tooth pattern 121 by an integral leaf spring-like arm 127 of the wiper contact means 23' that extends from the body portion 65 thereof and has an end 128 biased against a pin 129 having a shank portion 130 thereof disposed in the cylindrical opening 126 of the disk portion 105 and abutting against the ball 125.

Therefore, as the shaft 102 of the selector 24' is rotated, the detent ball 125 must move from one groove 124 over an adjacent tooth 123 and back into the next adjacent groove 124 in opposition to the force of the spring leg 127 so that a decided "feel" is provided to the user of the rotary switch construction 206 and permits that user to position the wiper contact means 23' in an incremental manner relative to the code pattern 22'.

Figure 15:
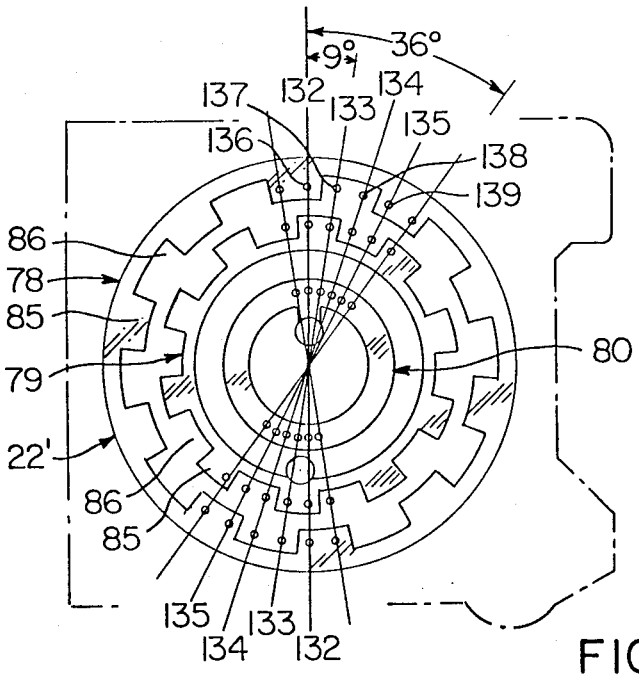
FIG. 15 is a schematic view similar to FIG. 12 and illustrates the code pattern of the rotary switch of FIG. 7.
Figure 14:
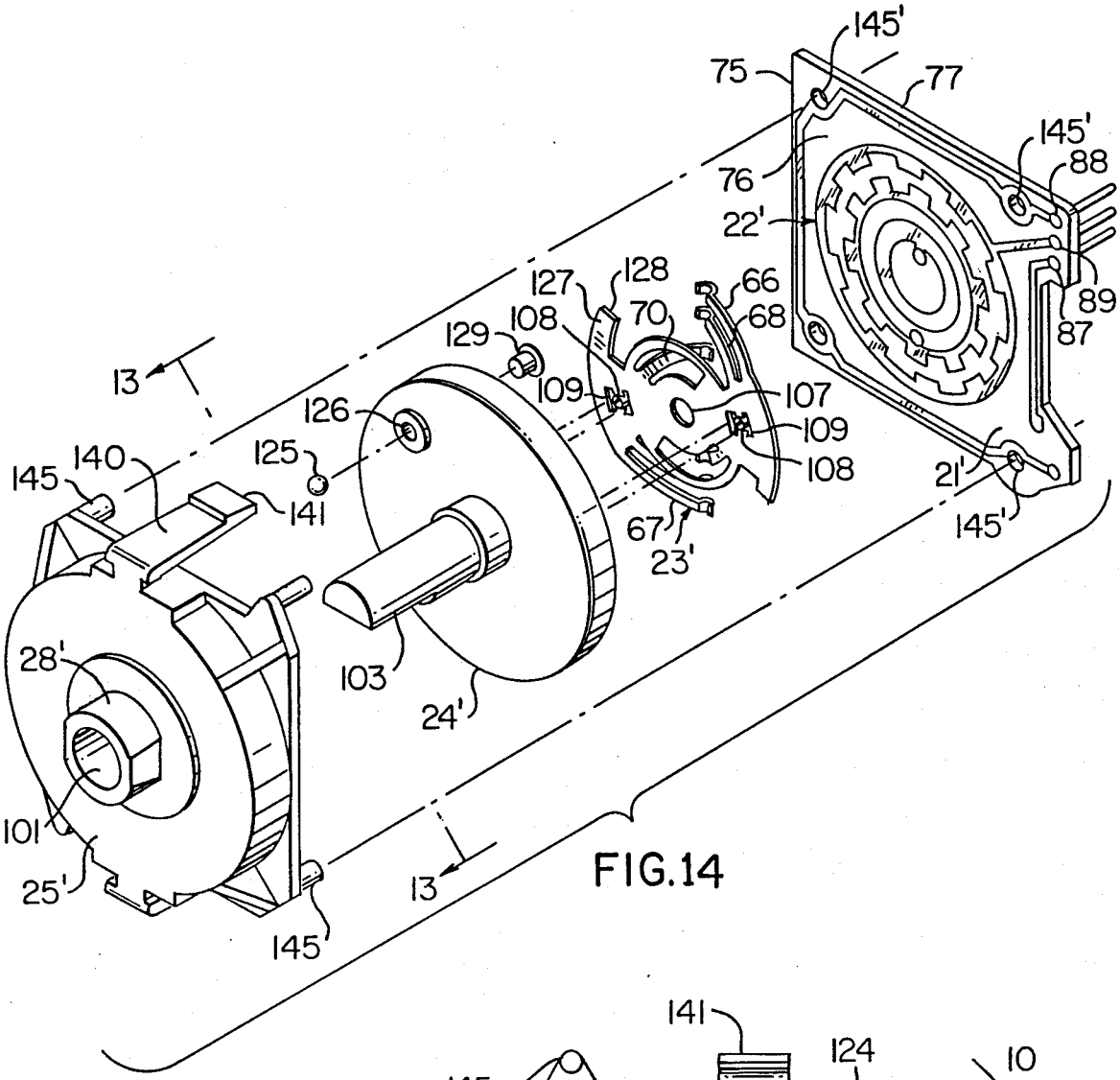
FIG. 14 is an exploded perspective view of the various parts of the rotary switch means of FIG. 7.
Figure 13:
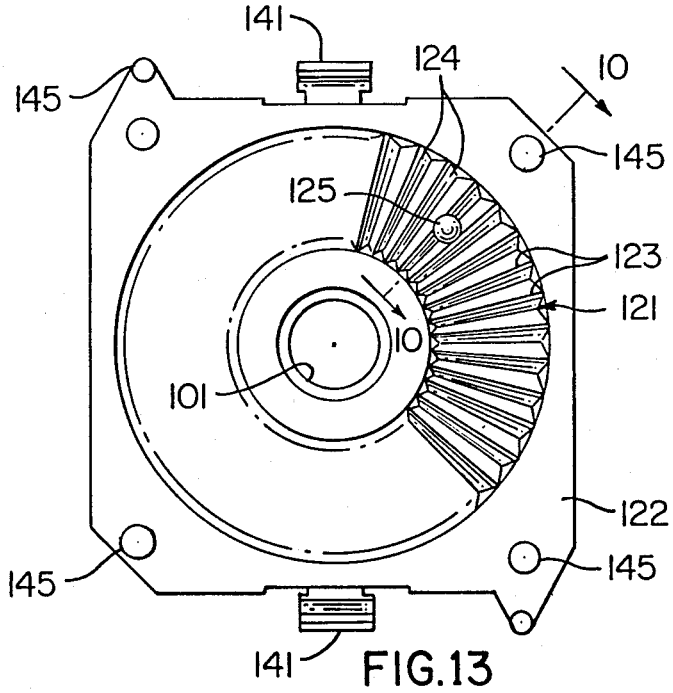
FIG. 13 is an end view of the inside surface of the cup-shaped housing member of the rotary switch means of FIG. 7 and illustrates the detent bail therein.

In particular, the code pattern 22' illustrated in FIGS. 12 and 15 has forty distinct code variations for each 360° rotatin of the shaft 102. Each of the concentric tracks or paths 78 and 79 has a 50% duty cycle of contact material 85 vs. insulating material 86 and the pattern of the paths 78 and 79 is each divided into four reference areas 132, 133, 134 and 135 as illustrated in FIG. 15. Each of these reference areas 132–135 comprises 9° of angular displacement. These four reference areas 132–135 form a repeating pattern each 36° of angular displacement which yields a total of forty distinct reference areas per 360° of angular displacement. The output of each path 78 and 79 during angular rotation provides a code pattern having two reference areas of electrically conducting material followed by two reference areas of nonconducting or insulating material as represented respectively by the reference points 136, 137, 138 and 139 in FIG. 15. As previously stated, the two paths 78 and 79 are related to each other in that the track 78 is offset relative to the track 79 by one reference area.

With such a code pattern 22' illustrated in FIG. 15 and utilizing the wiper contact means 23', it can be seen that as the shaft 102 is angularly moved, the code path 80 will be electrically connected and disconnected with the code paths 78 and 79. This electrical continuity will conduct a reference voltage applied to the circular path 80 by terminal 89 to the terminals 87 and 88. For example, if the shaft 102 is rotated in a clockwise direction as viewed in FIGS. 12 and 15, so as to position the ends 73 of the wiper contacts 66–71 to contact the points 136 along the reference line 132, a conductive path is provided from the common conductive path 80 to the paths 78 and 79. At this time, the detent ball 125 is disposed in a groove 124 of the tooth pattern 121 so as to provide the "feel" necessary for aligning the contact ends 73 along the line 132. Rotating the shaft 102 of the selector 24 9° clockwise to the reference position or line 133 of FIG. 15 where the detent ball 125 is now dispsoed in the next adjacent groove 124 of the tooth pattern 121, it can be seen that the conductive path 80 is no longer electrically connected to the conductive path 78 while the conductive path 80 is still conducting to the path 79. Rotating the shaft 102 an additional 9° to position or line 134 of FIG. 15, it can be seen that the wiper contact means 23 does not provide any electrical connection between the conductive path 80 and the two conductive paths 78 and 79. Rotating the shaft 102 another 9° to the reference position or line 135 of FIG. 15 causes the conductive path 80 to be conducting to the path 78 and non-conducting to the path 79. Further rotation of the shaft 102 in a clockwise direction will repeat the code pattern 132–135 for nine more cycles before the wiper contact means 23 is again positioned at the reference line 132, the detent tooth pattern 121 and ball 125 providing for the "feel" necessary for aligning and holding the wiper contact ends 73 along the selected reference line throughout such 360° rotation of the selector 24'.

However, it is to be understood that the number of incrementing phases of each complete rotation of the shaft 102 is dependent on the number of "on" and "off" patterns incorporated in 360°. For example, if there are ten "on" and "off" patterns for each 360° rotation of the pattern, there is a 4 to 1 multiplication and consequently there are forty distinct codes for each complete rotation of the pattern.

Since the code patterns 78 and 79 are offset, the wiper contact means 23' provides means for determining the direction of rotation of the shaft 102 depending upon whether the first path 78 or the second path 79 leads and changes from a conducting to a nonconducting condition. Such an arrangement permits the code of the code pattern 22' emitted by the rotary switch construction 206 to be supplied to a microprocessor in the form of a digital code to increment and decrement data, such as time and temperature into a microprocessor as previously set forth.

Therefore, it can be seen that the rotary switch construction 206 is to be operated by the operator merely turning the selector 24' in the desired direction relative to the housing member 25' to cause the wiper contact means 23' to have the ends 73 of the wiper contacts 66–71 respectively placed on certain portions of the respective circular paths 78–80 thereof to either electrically interconnect the common terminal 89 to one or both of the terminals 87 and 88 or to neither terminal 87 and 88 as previously set forth for the previously set forth purpose whereby a further discussion of the operation of the rotary switch construction of this invention is not necessary.

The rotary switch construction 206 is adapted to be mounted to the circuit board 31' of FIG. 8 to be electrically interconnected into the control system 29' thereof. For example, the housing member 25' can have a pair of tongues 140 provided with barbed ends 141 adapted to be snap-fitted into suitable openings (not shown) on the baord 31' as illustrated in FIG. 8 with the terminal pins 88–89 being adapted to be respectively received in suitable openings (not shown) in the board 31' and be electrically interconnected to the respective conductive paths 142, 143 and 144 by soldered connections thereto or the like.

In this manner, the board means 75 of the rotary switch is disposed against the larger board means 31'.

However, it is to be understood that the surface means 21' carrying the code pattern 22' of the rotary switch construction 206 can comprise part of the main circuit board 31' so that the rotary switch construction need only comprise the housing member 25', rotary selector 24' and wiper contact means 23' to be fastened to such board as the board itself provides the surface means 21'.

Therefore, it can be seen that the selector means 203 and 205 of the control device 200 of this invention can be utilized in the circuit 207 of FIGS. 16A–16D by being electrically interconnected to the microprocessor 204 thereof as illustrated in FIG. 16A to operate the microwave oven 202, the circuit means 207 of FIGS. 16A–16D being fully understandable to a person skilled in the art and, therefore, does not need to be described in detail as one of the main features of this invention is to utilize two rotary switch means for entering data into the microprocessor 204 in substantially the same manner as the rotary switch means SW1 previously described except that one of the rotary switch means of this invention controls the power level setting of the microprocessor.

In particular, the rotary switch means 205 of the control device 200 of this invention is adapted to select a time period as displayed on the display means 208 of the control device 200 of FIG. 1 by the operator rotating the knob means 209 of the selector means 205 in a clockwise direction to increment the desired time period into the microprocessor 204 or in a counterlcockwise direction to decrement at least part of such desired time period out of the microprocessor whereby the selector means 205 operates in substantially the same manner as the rotary switch means SW1 previously described for selecting a desired time period that the microprocessor 204 is to operate the power means or magnetron 201 of the microwave oven 202 when the start/cook actuator means 210 of FIG. 1 is subsequently actuated, the display means 208 being electrically interconnected to the microprocessor 204 as illustrated in FIG. 16B.

Should it be desired to utilize the microwave oven 202 with a meat probe rather than operate the microwave oven for the selected time period as set forth above, the plugging in of the meat probe 211, FIG. 16C, into the circuit 207 causes the microprocessor 204 to be adapted to have a desired internal temperature to which the particular meat item that is to be cooked in the microwave oven 202 must reach before the cooking operation is terminated programmed therein by the selector means 205. For example, with the meat probe 211 put in, the selector means 205 now will select the particular desired internal temperature which will appear in the display 208 through the rotation of the control knob 209 rather than have the display 204 indicating a time period, rotation of the control knob 209 in a clockwise direction increasing the temperature being selected as indicated at the display 208 whereas counterclockwise rotation of the control knob 209 decrements the temperature being indicated at the display 208 so that once the desired temperature has been selected by the selector means 205, subsequent actuation of the actuator means 210 will cause the microprocessor 204 to operate the power means 201 of the microwave oven 202 in a particular power mode thereof, as st by the selector means 203 as hereinafter set forth, until the internal temperature of the meat item that has the meat probe 211 inserted therein reaches the temperature that was selected by the selector means 205. At this time the microprocessor terminates the cooking operation.

When the control device 200 is to be utilized to select a desired cooking time period or desired internal temperature, by utilizing the selector means 205 to select such time period or temperature in the above manner, the selector means 203 can be utilized to select the desired power level that the power means 201 will be operating during such selected time period or temperature operation if the operator does not desire to utilize the normal preprogrammed power level setting of the microprocessor 204.

In particular, the operator can utilize the selector means 203 by grasping the control knob 212 thereof and rotating the same in a clockwise direction to select the desired power level that the microprocessor 204 is to operate the power means 201 during the cooking time period or temperature setting that has been or will be selected by the selector means 205, the microprocessor 204 indicating the selected power level in the display 208 in the area of the reference numeral 213. Rotation of the control knob 212 in one direction increases the power level setting and rotation of the control knob 212 in the opposite direction decreases the power level setting.

Once the desired power level has been selected by the selector means 203 and the desired time period or temperature has been selected by the selector means 205 as respectively displayed at the display means 208 of the control device 200, the operator then merely actuates the actuator 210 whereby the microprocessor 204, in a manner well known in the art, will cause the power means 201 of the microwave oven 202 to be operated at the selected power level for the selected time period or until the internal temperature of the meat item has reached the selected temperature if the meat probe 211 has been utilized at which time the microprocessor 204 will terminate the operation of the power means 201 of the microwave oven 202.

However, if at any time during an operation of the microwave oven 202 as set forth above should the operator desire to increase or decrease the selected time period or change the temperature setting, the operator merely adjusts the selected time or temperature by rotating the knob 209 of the selector means 205 to provide a new time period as desired, such adjustment of the time period or temperature during operation of a microwave oven being known as "adjusting on the fly". As previously stated, the selector means SW1 of the system 10 can likewise change the selected time period or temperature during a cooking operation.

Similarly, should the operator desire to change the selected power level during a cooking operation of the microwave oven 202, the operator can adjust the cooking level by merely rotating the knob 212 of the selector means 203 to a desired different power level and the microprocessor 204 will then cause the power means 201 to operate at the new power level for the remaining time period or cooking time that had been selected by the selector means 205 whereby the selector means 203 is also adapted to be "adjusted on the fly".

Also, it can be seen that both selector means 205 and 203, in a manner similar to the selector means SW1 previously described, are each adapted to provide a set sequence of the selection thereof as the particular selector means is being rotated in one direction from a beginning position thereof to an ending position thereof, the beginning position being the position where that selector means was last set for a previously desired setting of the microprocessor 204.

In particular, the selector means 203 for the power level setting of the microprocessor 204 and, thus, of the power means 201 of the microwave oven 202, is always at the beginning position of the set sequence of the power levels which in the embodiment of the control device 200 is the "full power" setting so that initial rotation of the control knob 212 in a clockwise direction causes a decrementing of the power level from the "full power" setting thereof all the way down to the ending position thereof which is the "warm" power level setting thereof. Of course, the set sequence could begin with the lowest "warm" power level setting and have the ending position of the sequence thereof being the high "full power" setting thereof, if desired, or any other desired sequence could be preprogrammed into the microprocessor 204 in a manner well known in the art.

In any event, when the selector means 203 had been utilized to select a desired power level setting, such as "bake" which is the numbered "7" power level setting thereof that will appear in the area 213 of the display 208, and the control device 200 had been utilized to operate the oven 202 by having had the actuator 210 actuated, the next time the operator wants to utilize the oven 202, the knob 212 is at the beginning position thereof so that initial movement thereof causes the power level setting to move through its set sequence whereby it can be seen that the selector means 203 is not sensitive to the initial rotary position of the shaft means 24' of the rotary switch means 206 thereof relative to the frame means of the control device 200 as is the case with the aforementioned slide switch means that required the slide member thereof to be moved to a "home position" thereof in order for that selector means to start the set sequence of selection thereof in contrast to the "ramdom" positioning of the selector means 203.

Of course, the selector means 205, as well as the switch means SW1 previously described, are also not sensitive to the initial position of the shaft of the rotary switch thereof relative to the frame means of the respective control device as the selector means 205 has a beginning position that is the position where the knob 209 of the selector means 205 was last set for a previously desired time period so that the set sequence of the time period begins with that particular last setting position of the control knob 209.

Therefore, it can be seen that the selector means 203 and 205 for the control device 200 of this invention can each comprise a rotary switch means that is substantially identical to the other rotary switch means. However, while the code pattern of the rotary switch means 203 is the same as the code pattern for the rotary switch means 205 and while the rotary switch means 205 utilizes all forty of the previously described reference areas thereof so that each reference area thereof causes a change in the increment or decrement of the time period, the microprocessor 204 is preprogrammed so that the rotary selector means 203 does not change a power level setting of the microprocessor 204 until after three such reference areas thereof have been covered by the rotation of the knob 212 in order to increase the total amount of rotation of the knob 212 that is required before a change is made in a power level selection thereof.

Also, while the selector means 203 and 205 can both utilize the ball detent means 125 previously described, in a preferred embodiment of the control device 200, the ball detent means 125 for the selector means 203 for the power level selection is not utilized in view of the aforementioned use of three reference areas of the code pattern before effecting a setting change thereof.

Therefore, it can be seen that this invention not only provides a new electrically operated control device and system for a microwave oven, but also this invention provides a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In an electrically operated system for a microwave oven that has power means for cooking food, said system comprising a microprocessor for operating said power means at various selected power levels thereof, a first selector means electrically interconnected to said microprocessor for selecting a desired power level that said microprocessor is to operate said power means, and a second selector means electrically interconnected to said microprocessor for selecting a desired time period that said microprocessor is to operate said power means at said desired power level thereof, the improvement wherein said first and second selector means each comprises a rotary switch means that is similar to the other rotary switch means, each said rotary switch means being electrically interconnected to said microprocessor in such a manner that the respective rotary switch means always selects the same set sequence of selection settings for said microprocessor as said respective rotary switch means is rotated in one direction from a beginning position thereof that selects a first selection of said sequence to an ending position thereof that selects a last selection of said sequence, the beginning position of each said rotary switch means always being the position where that respective rotary switch means was last set for a previously desired setting of said microprocessor by that respective rotary switch means even though said previously desired setting was a setting of said sequence other than said first selection thereof.

2. A system as set forth in claim 1 wherein each said rotary switch means is adapted to reverse the selection sequence of said selection settings thereof as the respective rotary switch means is rotated in the opposite direction from said one direction after said respective switch means has been rotated in said one direction to a desired position thereof.

3. A system as set forth in claim 1 and including a display means electrically interconnected to said microprocessor for indicating the settings being selected by said first and second selector means.

4. A system as set forth in claim 1 and including an actuator means electrically interconnected to said microprocessor which when actuated after said first and second selector means have respectively selected a desired power level and a desired time period will cause said microprocessor to operate said oven at that selected power level for that selected time period, each said rotary switch means being adapted to change its respective setting of said microprocessor to a new setting thereof after said actuator means has been actuated whereby said microprocessor will continue to operate said oven at those new settings thereof.

5. In an electrically operated system for a microwave oven that has power means for cooking food, said system comprising a microprocessor for operating said power means at various selected power levels thereof, and a selector means electrically interconnected to said microprocessor for selecting a desired power level that said microprocessor is to operate said power means, the improvement wherein said selector means comprises a rotary switch means that is electrically interconnected to said microprocessor in such a manner that said selector means always selects the same set sequence of said power levels as said selector means is rotated in one direction from a beginning position thereof that selects a first power level of said sequence to an ending position thereof that selects a last power level of said sequence, said beginning position always being the position where said selector means was last set for a previously desired power level setting of said microprocessor even though said previously described power level setting was a power level of said sequence other than said first power level thereof.

6. A system as set forth in claim 5 wherein said selector means is adapted to reverse the selection sequence of said power levels as said selector means is rotated in the opposite direction from said one direction after said selector means has been rotated in said one direction to a desired position thereof.

7. A system as set forth in claim 5 and including a display means electrically interconnected to said microprocessor for indicating the power levels being selected by said selector means.

8. A system as set forth in claim 5 wherein said rotary switch means comprises a rotary shaft means.

9. A system as set forth in claim 5 and including an actuator means electrically interconnected to said microprocessor which when actuated after said selector means has selected a desired power level will cause siad microprocessor to operate said oven at that selected power level, said selector means being adapted to change the power level setting of said microprocessor to a new power level after said actautor means has been actuated whereby said microprocessor will continue to operate said oven at that new power level.

* * * * *